US006152330A

United States Patent [19]

Polan

[11] Patent Number: 6,152,330

[45] Date of Patent: Nov. 28, 2000

[54] HINGED DISPENSER HOUSING

[75] Inventor: David L. Polan, Mason, Ohio

[73] Assignee: Chester Labs, Inc., Cincinnati, Ohio

[21] Appl. No.: 09/266,226

[22] Filed: Mar. 10, 1999

Related U.S. Application Data

[63] Continuation-in-part of application No. 29/100,471, Feb. 11, 1999, Pat. No. Des. 417,111.

[51] Int. Cl.[7] ..... B67D 5/38

[52] U.S. Cl. ..... 222/156; 222/181.3; 222/183; 222/209

[58] Field of Search ..... 222/103, 156, 222/181.3, 183, 207, 209

[56] References Cited

U.S. PATENT DOCUMENTS

| | | | |
|---|---|---|---|
| Re. 32,354 | 2/1987 | Savage | 222/81 |
| D. 124,199 | 12/1940 | Petzold . | |
| D. 246,338 | 11/1977 | Jespersen | D6/95 |
| D. 276,294 | 11/1984 | Banks | D6/545 |
| D. 302,916 | 8/1989 | Williamson | D6/542 |
| D. 312,184 | 11/1990 | De Luca et al. | D6/545 |
| D. 322,028 | 12/1991 | Appleby et al. | D9/370 |
| D. 337,908 | 8/1993 | Weber | D6/545 |
| D. 338,585 | 8/1993 | Bell et al. | D6/545 |
| D. 358,288 | 5/1995 | Daansen | D6/545 |
| D. 387,597 | 12/1997 | Kearnes | D6/545 |
| D. 392,136 | 3/1998 | Ross et al. | D6/542 |
| D. 392,137 | 3/1998 | Vignot . | |
| 2,932,431 | 4/1960 | Lipton | 222/93 |
| 3,459,343 | 8/1969 | Rasmussen | 222/477 |
| 3,768,704 | 10/1973 | Beguin | 222/207 |
| 3,926,347 | 12/1975 | Low et al. | 222/185 |
| 3,952,924 | 4/1976 | Benson | 222/181 |
| 4,018,363 | 4/1977 | Cassia | 222/80 |
| 4,036,406 | 7/1977 | Jespersen et al. | 222/181 |
| 4,149,573 | 4/1979 | Cassia | 141/18 |
| 4,151,867 | 5/1979 | Wilhere | 141/291 |
| 4,164,306 | 8/1979 | Perrin | 222/181 |
| 4,168,020 | 9/1979 | Benson | 222/207 |
| 4,238,056 | 12/1980 | Tucker et al. | 222/181 |
| 4,256,242 | 3/1981 | Christine | 222/207 |
| 4,324,348 | 4/1982 | Johnson et al. | 222/181 |
| 4,330,071 | 5/1982 | Ohlson | 222/207 |
| 4,345,627 | 8/1982 | Cassia | 141/18 |
| 4,349,133 | 9/1982 | Christine | 222/183 |
| 4,360,130 | 11/1982 | Nishimura et al. | 222/153 |
| 4,391,308 | 7/1983 | Steiner | 141/18 |
| 4,391,309 | 7/1983 | Steiner | 141/18 |
| 4,394,938 | 7/1983 | Frassanito | 222/207 |
| 4,429,812 | 2/1984 | Steiner et al. | 222/181 |
| 4,437,585 | 3/1984 | Banks | 222/181 |
| 4,452,379 | 6/1984 | Bundschuh | 222/207 |
| 4,463,876 | 8/1984 | Swallert | 222/94 |
| 4,493,440 | 1/1985 | von Buelow et al. | 222/109 |
| 4,515,294 | 5/1985 | Udall | 222/105 |
| 4,564,127 | 1/1986 | Garabedian et al. | 222/96 |
| 4,570,827 | 2/1986 | Roggenburg, Jr. et al. | 222/95 |
| 4,573,612 | 3/1986 | Maddison et al. | 222/94 |
| 4,621,749 | 11/1986 | Kanfer | 222/153 |
| 4,634,022 | 1/1987 | O'Halloran et al. | 222/95 |
| 4,651,904 | 3/1987 | Schuckmann | 222/383 |
| 4,667,854 | 5/1987 | McDermott et al. | 222/101 |
| 4,673,109 | 6/1987 | Cassia | 222/153 |

(List continued on next page.)

FOREIGN PATENT DOCUMENTS

| | | | |
|---|---|---|---|
| 2715962 | 10/1978 | Germany | 222/103 |
| 2 155 435 | 9/1985 | United Kingdom . | |

*Primary Examiner*—Joseph A. Kaufman
*Attorney, Agent, or Firm*—Wood, Herron & Evans, L.L.P.

[57] ABSTRACT

There is provided a dispensing apparatus in which the housing includes a cover pivotally attached to a backing plate. The cover is movable from a fully open position in which a liquid container may be inserted therein to a closed position, and the cover may be latched to the backing plate in the closed position. When closed, the cover may be pushed from a non-dispensing position in which no liquid is dispensed from the container to an engaging position in which a projection on the interior surface of the cover engages and actuates a bulb-type pressure valve to dispense liquid from the container through a dispensing tube from the bottom of the housing.

20 Claims, 2 Drawing Sheets

U.S. PATENT DOCUMENTS

| | | | |
|---|---|---|---|
| 4,678,106 | 7/1987 | Newell et al. | 222/162 |
| 4,741,461 | 5/1988 | Williamson et al. | 222/181 |
| 4,778,085 | 10/1988 | Bush et al. | 222/207 |
| 4,828,150 | 5/1989 | Bottger et al. | 222/207 |
| 4,874,023 | 10/1989 | Ulm | 141/346 |
| 4,932,562 | 6/1990 | Christine | 222/96 |
| 4,932,624 | 6/1990 | Holm | 248/311.3 |
| 4,949,877 | 8/1990 | Hanna et al. | 222/341 |
| 4,953,758 | 9/1990 | Passalacqua | 222/341 |
| 4,991,635 | 2/1991 | Ulm | 141/346 |
| 5,000,350 | 3/1991 | Thomsen | 222/103 |
| 5,016,779 | 5/1991 | Williamson | 222/95 |
| 5,031,676 | 7/1991 | Ulm | 141/346 |
| 5,067,635 | 11/1991 | Thomsen | 222/103 |
| 5,100,030 | 3/1992 | Roggenburg, Jr. et al. | 222/181.3 |
| 5,105,984 | 4/1992 | Kazimir | 222/103 |
| 5,108,007 | 4/1992 | Smith et al. | 222/95 |
| 5,121,778 | 6/1992 | Baker et al. | 141/319 |
| 5,178,300 | 1/1993 | Haviv et al. | 222/95 |
| 5,183,182 | 2/1993 | Comstock et al. | 222/181.3 |
| 5,207,250 | 5/1993 | Tsao | 141/65 |
| 5,242,083 | 9/1993 | Christine et al. | 222/185 |
| 5,265,772 | 11/1993 | Bartasevich et al. | 222/214 |
| 5,273,083 | 12/1993 | Burrows | 141/18 |
| 5,320,256 | 6/1994 | Wood | 222/212 |
| 5,398,845 | 3/1995 | Meyer | 222/1 |
| 5,439,140 | 8/1995 | Meyer | 222/110 |
| 5,443,236 | 8/1995 | Bell et al. | 248/311.3 |
| 5,465,877 | 11/1995 | Bell et al. | 222/181.2 |
| 5,492,247 | 2/1996 | Shu et al. | 222/63 |
| 5,544,788 | 8/1996 | Meyer | 222/110 |
| 5,556,005 | 9/1996 | Banks | 222/96 |
| 5,638,989 | 6/1997 | Ophardt et al. | 222/105 |
| 5,638,994 | 6/1997 | Libit et al. | 222/207 |
| 5,791,525 | 8/1998 | Fan | 222/181.3 |
| 5,806,717 | 9/1998 | De Rosenzeig-Page et al. | 222/105 |
| 5,810,204 | 9/1998 | Devlin et al. | 222/82 |
| 5,901,886 | 5/1999 | Grindstaff et al. | 222/156 |
| 5,906,299 | 5/1999 | Hagleitner | 222/181.3 |

HINGED DISPENSER HOUSING

CROSS REFERENCE TO RELATED APPLICATION

This application is a continuation-in-part application of U.S. Design patent application Ser. No. 29/100,471 filed Feb. 11, 1999 entitled "Hinged Dispenser Housing" now U.S Design Pat. No. D 417,111.

FIELD OF THE INVENTION

This invention relates to a hinged dispenser housing for dispensing a liquid product from a container.

BACKGROUND OF THE INVENTION

A wide variety of housing assemblies are known in the art for dispensing liquids from a variety of container configurations. Many of these housings include a lever that is pushed or pulled to dispense a liquid from the container. The hygienic requirements for dispensing various liquids differ from one environment to another. In hospitals, for example, levers that are repeatedly touched by bare hands can serve to spread germs from person to person through contact with the hands.

Samhall Femett AB, Sollentuna, Sweden, provides a liquid dispenser marketed under the trademark DISPENSO-PAC® for use in environments with high hygienic demands. A long armlever or push bar is provided such that the liquid can be dispensed by pressing on the end of the lever with a person's elbow or forearm, such that the hands do not contact the lever. The lever engages a pump for dispensing a quantity of liquid soap. In the Samhall Femett product, the armlever is connected to a wall mounted bracket, which holds a pouch-like container to which the pump or valve is connected.

In the hospital and other environments, it is undesirable to have a lever protruding outwardly from the container that could catch people or devices passing by. In some dispensing systems, such as those disclosed in U.S. Pat. Nos. 3,926,347; 4,324,348; and 4,932,562, a housing is provided having an internal actuating means that engages a wall of a pouch within the housing that contains the liquid to be dispensed. In these systems, although the protruding lever is eliminated, it is difficult to achieve complete evacuation of the contents of the liquid pouch and contaminating air may be drawn into the container after release of the lever.

It is thus desirable to provide a dispensing housing operable in high hygienic demanding environments that also achieves a complete evacuation of the contents of the liquid soap, prevents air from being drawn thereinto, and is not overly obtrusive.

SUMMARY OF THE INVENTION

The present invention provides a dispenser housing wherein the cover of the housing is movable and itself may be engaged in a hygienic manner and moved to dispense the liquid product. This housing is operable with containers that are capable of achieving a complete evacuation of the contents, thus providing a hygienic and economic liquid soap dispensing unit. To this end, and in accordance with the principles of the present invention, a dispenser housing is provided having a cover plate pivotally connected to a backing plate, the backing plate and cover plate together forming an enclosure or cavity that holds the liquid container. The cover plate is movable with respect to the backing plate from an open position in which the container may be loaded and unloaded to a closed position enclosing the liquid container. A latch may be provided to releasably latch the cover in the closed position. In the closed position, the cover plate is movable over a limited range between a) an outer non-dispensing position in which a projection on the inner surface of the cover plate aligned with a depressable actuator of a valve connected to the liquid container does not depress the depressable valve actuator, and b) an inner liquid-dispensing position in which the projection on the interior of the cover plate contacts and depresses the valve actuator to dispense liquid from the bottom of the dispenser housing.

In accordance with a further feature of the present invention, the cover plate is configured such that it at least partially overlaps the backing plate to provide a substantially closed chamber or cavity for encasing the liquid container. A cut-out may be provided in the cover to facilitate visually monitoring the level of liquid in the container.

In accordance with a still further feature of the present invention, the projection has a rounded tip adapted to depress a bulb actuator of a bulb-type pressure valve to dispense liquid from the bottom of the dispenser housing.

These and other objects, features and advantages of the present invention shall become more apparent from the accompanying drawings and description thereof.

BRIEF DESCRIPTION OF THE DRAWING

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Figure 2:
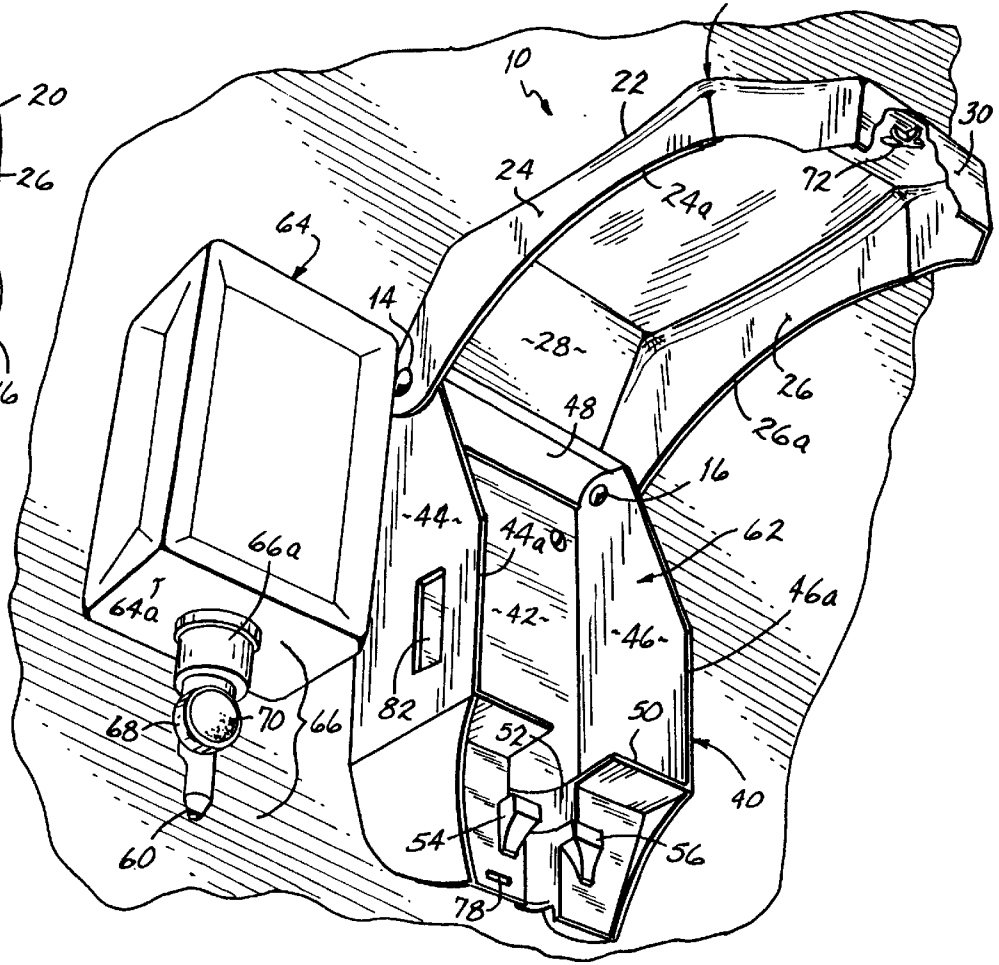
FIG. 2 is a perspective view of the hinged dispenser housing of the present invention with the cover in the open, loading position and partially cutaway to show the projection on the internal surface thereof.
Figure 1:
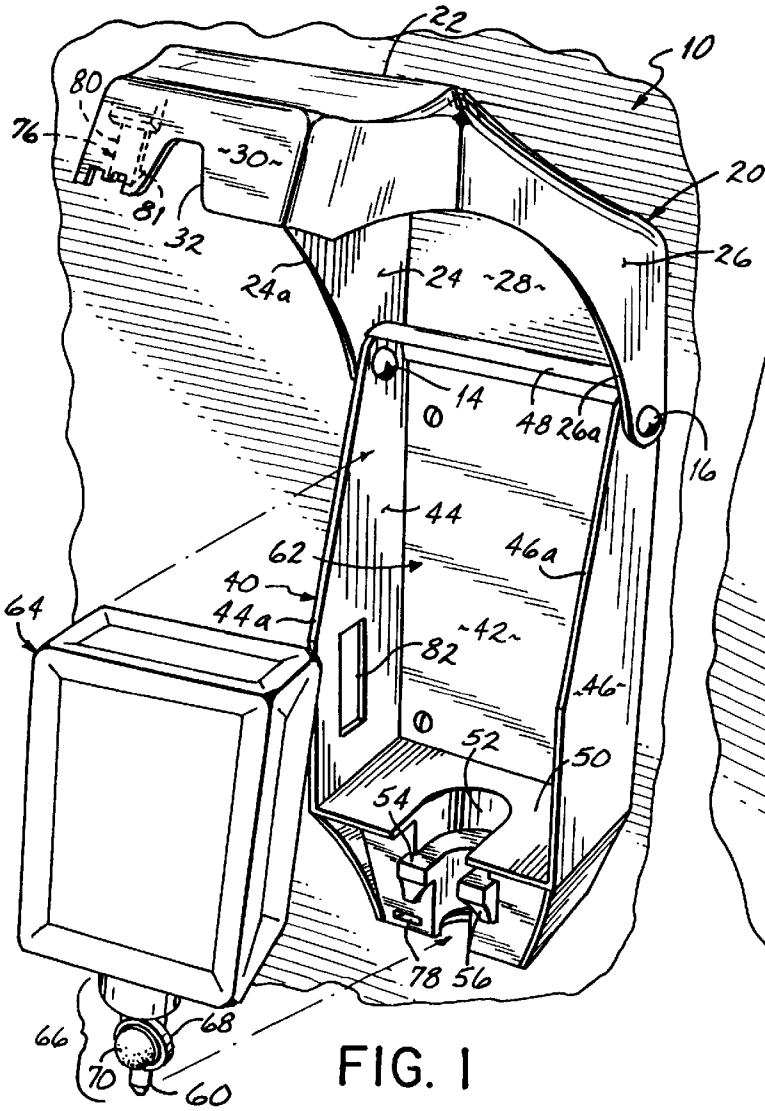
FIG. 1 is a perspective view of the hinged dispenser housing of the present invention with the cover in the open, loading position, with the liquid container located in an external position prior to insertion into the housing interior.
Figure 3:
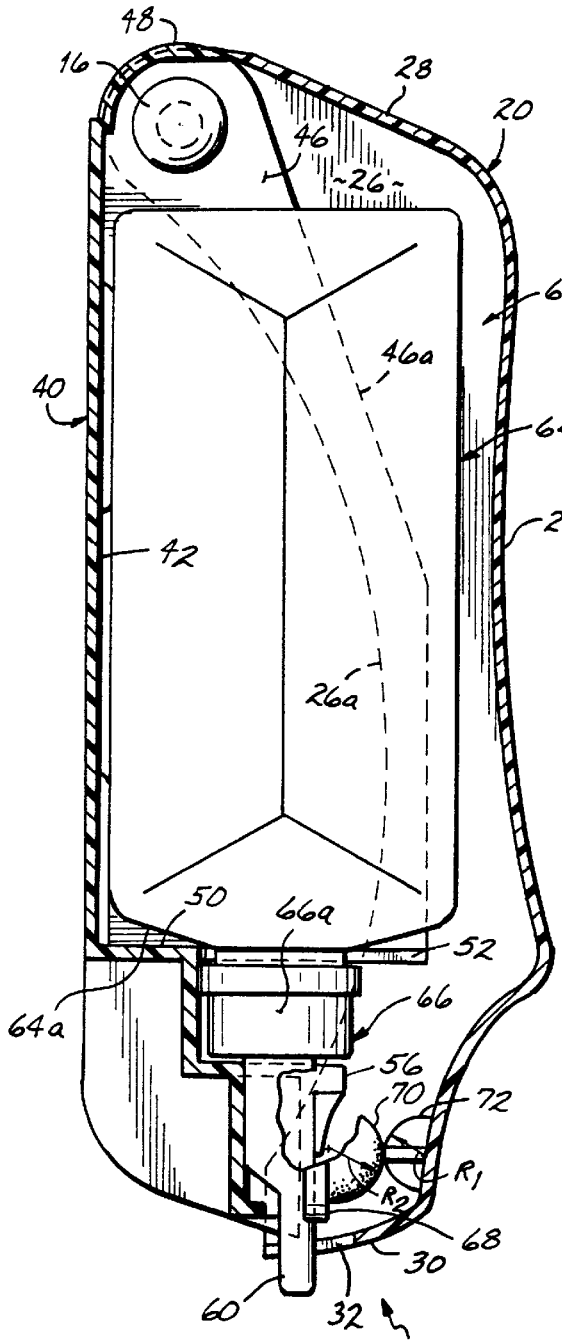
FIG. 3 is a cross-sectional side view of the hinged dispenser housing of the present invention in the closed, non-dispensing position having a container held therein.
Figure 4:
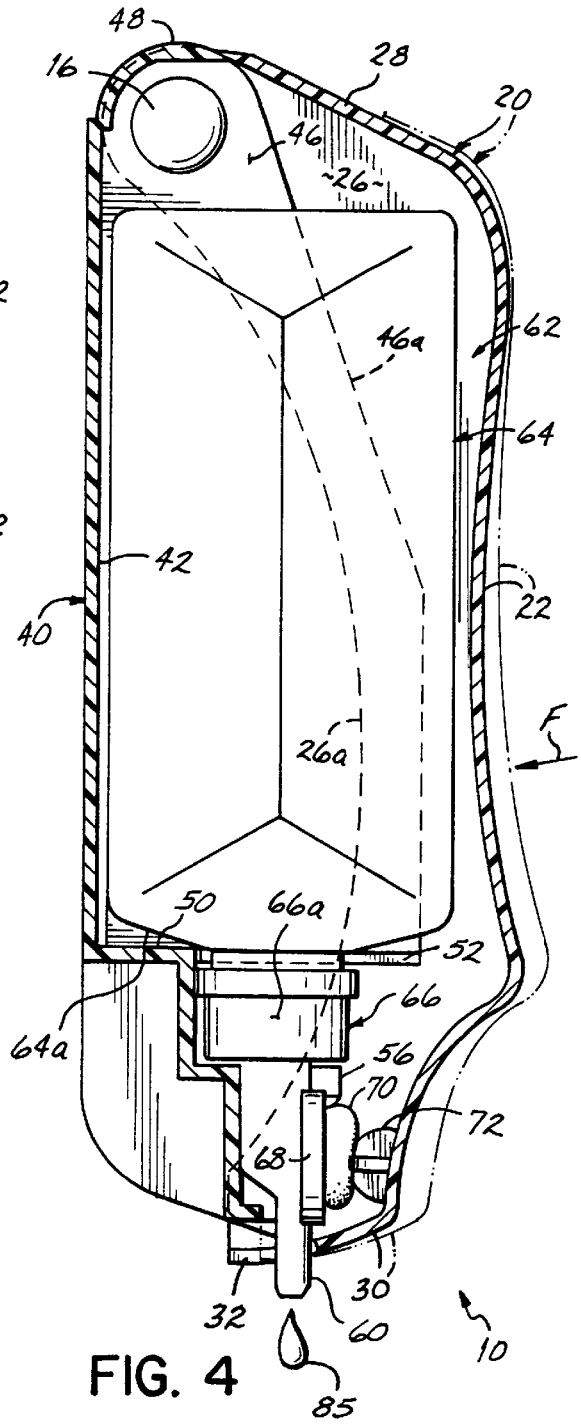
FIG. 4 is a cross-sectional side view of a hinged dispenser housing of the present invention in the closed, liquid-dispensing position.

Referring to FIGS. 1 and 2, the dispenser housing 10 of the present invention has a cover plate 20 pivotally connected via hinge pins 14,16 to a backing plate 40. The cover plate 20 has a front panel 22, two side panels 24,26, a top panel 28, and a bottom panel 30. The backing plate 40 has a back panel 42, which may be mounted to a wall or other vertical surface, two side panels 44,46, a top panel 48 and a bottom panel 50. The top panel 28 of the cover plate 20 fits over the top panel 48 of the backing plate 40 such that upon opening and closing of the cover plate 20, the top panel 28 of the cover plate 20 slides over the top panel 48 of the backing plate 40 without mechanical interference. The side panels 24 and 26 of the cover plate 20 have rear edges 24*a* and 26*a*, respectively. The side panels 44 and 46 of the backing plate 40 have forward edges 44*a* and 46*a*, respectively. The side panels 24 and 26 of the cover plate 20 fit over and slightly overlap the side panels 44 and 46 of the backing plate 40, as shown in FIGS. 3 and 4, or they may substantially overlap, as desired. The bottom panel 30 of the cover plate 20 extends below the bottom panel 50 of the backing panel 40, as shown in FIGS. 3 and 4.

The cover plate 20 and backing plate 40 together form a chamber or cavity 62 in which a liquid container 64 is held. The container 64 is placed in an inverted position inside the cavity 62, with the bottom panel 50 of the backing plate 40 supporting the shoulders of the container 64. Cut-outs 32 and 52 are provided in the bottom panels 30 and 50, respectively, of the cover and backing plates 20 and 40, respectively, such that a liquid-dispensing tube 60 integral with container 64 or connected thereto may extend from the container through the bottom of the dispenser housing 10 for the convenient dispensing of liquid to a user. The bottom panel 50 of the backing plate 40 may further comprise support flanges 54,56 connected to the underside of the bottom panel for supporting a valve housing 66 located between the container 64 and the dispensing tube 60. The valve housing 66 preferably includes a depressable bulb-type pressure valve 68 having a hemispherical depressable bulb 70 facing outwardly toward the cover plate 20 of the dispenser housing 10 for reasons which will become apparent below. The upper end 66*a* of the valve 66 is preferably internally threaded and connects to an externally threaded tube extending from the container panel 64*a*. The dispensing tube 60 is integral with the body of the valve 68.

In accordance with the principles of the present invention, as shown in FIGS. 2–4, the cover plate 20 of the dispenser housing 10 is provided with a projection 72 on the inner surface of the front panel 22 that extends into the cavity 62, and is positioned such that it is in alignment with the arcuate bulb 70 of valve 68. The projection 72 preferably has a rounded tip that is adapted, when the cover plate 20 is urged toward the backing plate 40 to its liquid-dispensing position, to depress the bulb 70 of the bulb-type pressure valve 68 to dispense liquid therefrom, without puncturing the bulb 70. The tip of projection 72 and the bulb 70 each have a radius of curvature, and the radius $R_1$ of the tip of the projection 72 is preferably less than the radius $R_2$ of the bulb 70. Preferably, the radius $R_1$ of the tip of projection 72 is between about 30% and about 80% of the radius $R_2$ of the bulb 70 for full actuation of the valve with minimum actuation force required. For example, a bulb-type pressure valve made according to the disclosure of U.S. Pat. No. 4,330,071, incorporated by reference herein in its entirety, and sold commercially by Samhall Femmett AB as the 3MP™ pump, has a bulb radius of about 0.395 inch. The projection 72 adapted to engage the 3MP™ will advantageously have a radius ranging from about 0.118 inch to about 0.316 inch, and preferably about 0.312 inch. The pressure valve 68, when depressed, operates to dispense a quantity of liquid while preventing the back flow of air into container 64, thereby preventing contamination of the liquid contents and allowing complete evacuation of the container as the container collapses as described in co-pending U.S. Pat. application Ser. No. 09/266227, entitled "Collapsible Container," filed on even date herewith, in the name of David L. Polan, assigned to the assignee of this application, incorporated herein in its entirety by reference.

The cover plate 20 is movable from an open, container-loading position, as shown in FIG. 1, to a closed, non-dispensing position, as shown in FIG. 3, and to a closed, liquid-dispensing position, as shown in FIG. 4. In the open, container-loading position, a container 64 of liquid may be inserted into the cavity 62 in the inverted position, so as to rest on the bottom panel 50 of the backing plate 40. The cavity 62 of dispenser housing 10 is adapted to house a collapsible container, preferably of the type described in the aforesaid Polan application entitled "Collapsible Container". The cover plate 20 may then be closed to its non-dispensing position where the projection 72 is aligned with the bulb 70 of the pressure valve 68, but does not depress it, as shown in FIG. 3. Upon force being applied in a generally transverse direction to the outer surface of the front panel 22 of the cover plate 20 in the direction of arrow F, as shown by the arrow in FIG. 4, the projection 72 engages bulb 70 and actuates the pressure valve 68, thus dispensing liquid from the dispensing tube 60. Upon release of the force applied to the front panel 22, the cover plate 20 returns from the engaging position to the non-engaging position by virtue of the expansion of bulb 70.

The cover plate 20 and backing plate 40 may further comprise a releasable latching device 76 for releasably latching the cover plate 20 in the closed position. As shown in FIG. 1, the backing plate 40 is provided with a slot 78 and the cover plate 20 is provided with a tab 80 fixedly mounted to the interior of the cover bottom panel 30 such that upon closing of the cover plate 20, the tab 80 is inserted through the slot 78 in the backing plate 40. A protrusion 81 on the end of the tab allows it to hold the cover plate 20 in the closed position. It is to be understood, however, that any other latching device known to one skilled in the art may be provided for use with the dispenser housing of the present invention. The latching device 76 should, however, enable movement in the closed, latched position between the outer non-dispensing position and the inner liquid-dispensing position.

The dispenser housing 10 of the present invention may be further provided with a cut-out 82 in one or both side panels 44,46 of the backing plate 40, and in the side panels 24,26 of the cover plate 20 if necessary, to provide visual access to the liquid container 64 for determining the amount of liquid remaining in the container 64. If the side panels of the cover plate and backing plate only overlap slightly, a cut-out 82 will only be necessary in the side panel of the backing plate. If the side panel of the cover plate substantially overlaps the side panel of the backing plate, such that the cut-out 82 in the side panel of the backing plate is visually obscured, then a cut-out 82 will also be needed in the side panel of the cover plate. The cut-out 82 in the side panel 44, as shown in FIGS. 1 and 2, is advantageously located in close proximity to the bottom panel 50 of the backing plate 40 on which the container rests.

In use, the cover plate 20 of the dispenser housing 10 is pivoted upwardly to provide access to the cavity 62 within the dispenser housing 10. The container 64 of a liquid is inserted into the cavity 62 in the inverted position with the shoulders of the container 64 resting on the bottom panel 50 of the backing plate 40 and the dispenser tube 60 with valve housing 66 extending below the bottom panels 30,50 through to the bottom of the dispenser housing 10. The cover plate 20 is pivoted downwardly and latched into the backing plate by the interaction of latching tab 80 and slot 78 to releasably latch the cover plate 20 in a closed position. Force in the direction of arrow F (FIG. 4) may then be applied to the cover plate 20 such that the projection 72 on the inner surface of the cover plate 20 engages the bulb 70 of the bulb-type pressure valve 68 to dispense liquid 85 from the dispenser tube 60 into a person's hand located below dispenser tube 60. Force applied to the cover is then released, which then returns the cover plate 20 to a non-dispensing position under the action of the expanding bulb 70 in which the projection 72 does not depress bulb 70. Force may be applied to the cover plate 20 by the user's hand, elbow, forearm, shoulder, or any other convenient means to provide the desired degree of hygiene as the particular situation requires. This dispensing action may be repeated until there has been a substantially complete evacuation of the liquid contents of the container 64. There is thus provided an unobtrusive dispenser housing for dispensing liquid products that may be used in high-hygienic applications with little or no waste of the liquid product, and which hides and protects the liquid container.

While the present invention has been described and illustrated in connection with a preferred embodiment thereof, and while the preferred embodiment has been described in considerable detail, it is not intended to restrict or in any way limit the scope of the appended claims to such details. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope or spirit of applicant's general inventive concept.

What is claimed is:

1. A dispensing apparatus for dispensing a product from a container located therein which is provided with an actuatable valve, comprising:

a housing have a backing plate and a cover plate pivotally connected to the backing plate, the cover plate being movable with respect to the backing plate from an open, container-loading position to a closed, non-dispensing position and to a closed, product-dispensing position, the cover plate and backing plate together forming a cavity adapted to enclose and hold a container of the product to be dispensed located therein;

an opening in a bottom portion of the housing through which a product is dispensable; and a projection on an inner surface of the cover plate, the projection extending into the cavity formed by the cover plate and backing plate, the projection being so positioned and configured such that upon movement of the cover plate from the closed, non-dispensing position to the closed, product-dispensing position, only the actuatable valve of product container located in said cavity is engaged by said projection and said valve actuated to dispense product within said container from the bottom portion of the housing.

2. The apparatus of claim 1, further comprising a selectively releasable latching device mounted to the cover plate and the backing plate whereby the cover plate is a) latched to the backing plate in the closed position, yet is movable in the closed position between product-dispensing and non-dispensing positions, and b) unlatched to the backing plate in the open position to facilitate insertion and removal of a product container within the cavity.

3. The apparatus of claim 1, wherein the cover plate comprises interconnected front, first and second side, top and bottom panels, and the backing plate comprises interconnected back, first and second side, top and bottom panels, and wherein the top panel of the cover plate at least partially overlaps the top panel of the backing plate, the first and second side panels of the cover plate at least partially overlap the first and second side panels of the backing plate, and the bottom panel of the cover plate at least partially overlaps the bottom panel of the backing plate.

4. The apparatus of claim 3, wherein the bottom panel of the backing plate is adapted to support a container of product to be dispensed through the opening in the bottom of the housing.

5. The apparatus of claim 3, wherein at least one of the side panels of the backing plate includes a cut-out unobscured by a side panel of the cover when the cover is in its closed position for viewing the level of product in a container located within the cavity when the cover is in its closed position.

6. The apparatus of claim 1, wherein the projection has a rounded tip adapted to depress an approximately hemispherically-shaped bulb of a bulb-type pressure valve to dispense product therefrom.

7. The apparatus of claim 6, wherein the tip and bulb each have a radius of curvature, with the radius of curvature of the tip of the projection being less than the radius of curvature of the bulb.

8. The apparatus of claim 7, wherein the radius of curvature of the tip of the projection is about 30% to about 80% of the radius of curvature of the bulb.

9. A product dispensing apparatus comprising:

a container enclosing a product to be dispensed a bulb-type pressure valve having a depressable actuator, an inlet and an outlet, said valve adapted to have its inlet connect to said container to facilitate selective dispensing of the product via said outlet to a location external to said dispensing apparatus;

a housing comprising a backing plate and a cover plate pivotally connected to the backing plate, the cover plate and backing plate together forming a cavity adapted to hold said container, and the cover plate being movable with respect to the backing plate from an open, container-loading position to a closed, non-dispensing position and to a closed, product-dispensing position; and a projection on an inner surface of said cover plate, the projection extending into said cavity formed by said cover plate and backing plate, said projection being aligned with said depressable actuator of said bulb-type pressure valve such that upon movement of the cover plate from the closed, non-dispensing position to the closed, product-dispensing position the valve actuator is depressed and the valve actuated to dispense product through the outlet of the valve to said location external to said dispensing apparatus.

10. The apparatus of claim 9, further comprising a selectively releasable latching device mounted to the cover plate and the backing plate whereby the cover plate is a) latched to the backing plate in the closed position, yet is movable in the closed position between product-dispensing and non-dispensing positions, and b) unlatched to the backing plate in the open position to facilitate insertion and removal of a product container within the cavity.

11. The apparatus of claim 9, wherein the cover plate comprises interconnected front, first and second side, top and bottom panels, and the backing plate comprises interconnected back, first and second side, top and bottom panels, and wherein the top panel of the cover plate at least partially overlaps the top panel of the backing plate, the first and second side panels of the cover plate at least partially overlap the first and second side panels of the backing plate, and the bottom panel of the cover plate at least partially overlaps the bottom panel of the backing plate.

12. The apparatus of claim 11, wherein at least one of the side panels of the backing plate includes a cut-out unobscured by a side panel of the cover when the cover is in its closed position for viewing the level of product in a container located within the cavity when the cover is in its closed position.

13. The apparatus of claim 11, wherein the bottom panels of the cover plate and backing plate each include a cut-out through which the outlet of the valve extends when the cover is in its closed position.

14. The apparatus of claim 13, wherein the bottom panel of the backing plate surrounding the cut-out thereof is adapted to support said container with the outlet extending therethrough to below the housing.

15. The apparatus of claim 9, wherein the projection has a rounded tip adapted to depress an approximately hemispherically-shaped bulb of a bulb-type pressure valve to dispense product therefrom.

16. The apparatus of claim 15, wherein the tip and bulb each have a radius of curvature, with the radius of curvature of the tip of the projection being less than the radius of curvature of the bulb.

17. The apparatus of claim 16, wherein the radius of curvature of the tip of the projection is about 30% to about 80% of the radius of curvature of the bulb.

18. A dispensing apparatus for dispensing a product from a container located therein which is provided with an actuatable bulb-type pressure valve having an approximately hemispherically-shaped bulb, comprising:

a housing have a backing plate and a cover plate pivotally connected to the backing plate, the cover plate being movable with respect to the backing plate from an open, container-loading position to a closed, non-dispensing position and to a closed, product-dispensing position, the cover plate and backing plate together forming a cavity adapted to enclose and hold a container of the product to be dispensed located therein:

an opening in a bottom portion of the housing through which a product is dispensable; and a projection having a rounded tip on an inner surface of the cover plate, the projection extending into the cavity formed by the cover plate and backing plate, the projection being so positioned and configured such that upon movement of the cover plate from the closed, non-dispensing position to the closed, product-dispensing position, the bulb of the actuatable valve of product container located in said cavity is engaged by the rounded tip of said projection and said valve actuated to dispense product within said container from the bottom portion of the housing.

19. The apparatus of claim 18, wherein the tip and bulb each have a radius of curvature, with the radius of curvature of the tip of the projection being less than the radius of curvature of the bulb.

20. The apparatus of claim 19, wherein the radius of curvature of the tip of the projection is about 30% to about 80% of the radius of curvature of the bulb.

* * * * *